US006705503B1

(12) United States Patent
Pedicini et al.

(10) Patent No.: US 6,705,503 B1
(45) Date of Patent: Mar. 16, 2004

(54) ELECTRICAL MOTOR DRIVEN NAIL GUN

(75) Inventors: Christopher S. Pedicini, Roswell, GA (US); John D. Witzigreuter, Kennesaw, GA (US)

(73) Assignee: Tricord Solutions, Inc., Roswell, GA (US)

( * ) Notice: Subject to any disclaimer, the term of this patent is extended or adjusted under 35 U.S.C. 154(b) by 0 days.

(21) Appl. No.: 10/375,313

(22) Filed: Feb. 26, 2003

Related U.S. Application Data

(63) Continuation-in-part of application No. PCT/US02/23724, filed on Jul. 26, 2002, and a continuation-in-part of application No. 10/091,410, filed on Mar. 7, 2002, now Pat. No. 6,604,666.

(60) Provisional application No. 60/313,618, filed on Aug. 20, 2001.

(51) Int. Cl.[7] ..... B25C 1/06

(52) U.S. Cl. ..... 227/131; 227/2; 227/120; 227/132; 227/134; 173/124; 173/205

(58) Field of Search ..... 227/2, 131, 120, 227/129, 132, 134; 173/124, 205

(56) References Cited

U.S. PATENT DOCUMENTS 4,530,454 A * 7/1985 Gloor et al. ..... 227/129
4,640,452 A * 2/1987 Matt et al. ..... 227/131
4,953,774 A * 9/1990 Lai ..... 227/131
4,964,558 A * 10/1990 Crutcher et al. ..... 227/8
5,098,004 A * 3/1992 Kerrigan ..... 227/134
5,320,270 A * 6/1994 Crutcher ..... 227/131
5,495,161 A * 2/1996 Hunter ..... 318/807
5,511,715 A * 4/1996 Crutcher et al. ..... 227/131
5,927,585 A * 7/1999 Moorman et al. ..... 227/132
6,604,666 B1 * 8/2003 Pedicini et al. ..... 227/131

* cited by examiner

*Primary Examiner*—Scott A. Smith
(74) *Attorney, Agent, or Firm*—Moore Ingram Johnson & Steele, LLP; Jonathan H. Petcu, Esq.

(57) ABSTRACT

A portable electric nailing gun operating from a power supply. The motor accelerates a flywheel, which at the appropriate energy state is coupled through a mechanism to an anvil acting directly on the nail. The actuation is governed by a control circuit and initiated from a trigger switch. The stored energy delivered from the motor is coupled to the output anvil drives the nail. At least one position of the output anvil is sensed and once the nail is driven, the power is disconnected from the motor. This method uses a direct acting clutch and a harmonic motion nailing mechanism to reduce wear and increase robustness of the nailer. Elastic elements are used to limit stresses during the impact periods. The electrical control circuit and sensors allow precise control and improve safety. The power supply is preferably a rechargeable low impedance battery pack.

22 Claims, 8 Drawing Sheets

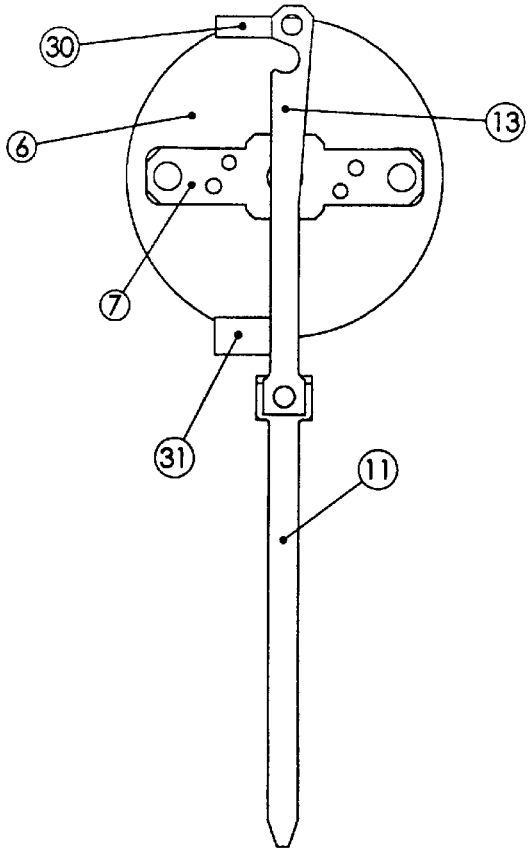
FIG. 4a
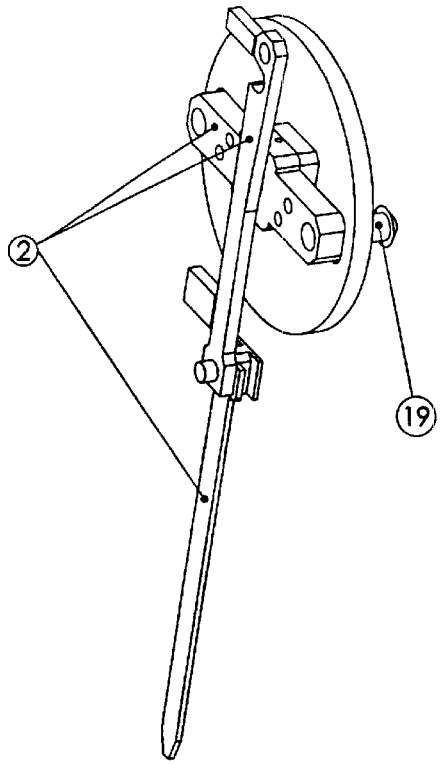

FLOWCHART ELECTRICALLY ACTUATED CLUTCH

ELECTRICAL MOTOR DRIVEN NAIL GUN

CROSS-REFERENCE TO RELATED APPLICATIONS

This application is a continuation-in-part of International Application PCT/US02/23724, filed on Jul. 26, 2002 and U.S. patent application Ser. No. 10/091,410 filed on Mar. 7, 2002 now U.S. Pat. No. 6,604,666.

BACKGROUND OF INVENTION

This invention relates to fastening mechanisms, specifically to such nail or staple fastening mechanisms that require operation as a hand tool. This invention relates generally to an electromechanical fastener driving tool. Such devices are less than 15 pounds and are completely suitable for an entirely portable operation.

Contractors and homeowners commonly use power-assisted means of driving fasteners into wood. These can be either in the form of finishing nail systems used in baseboards or crown molding in house and household projects, or in the form of common nail systems that are used to make walls or hang sheathing onto same. These systems can be portable (not connected or tethered to an air compressor or wall outlet) or non-portable.

The most common fastening system uses a source of compressed air to actuate a cylinder to push a nail into the receiving members. For applications in which portability is not required, this is a very functional system and allows rapid delivery of nails for quick assembly. It does however require that the user purchase an air compressor and associated air-lines in order to use this system.

Thereafter, inventors have created several types of portable nail guns operating off of fuel cells. Typically these guns have a cylinder in which a fuel is introduced along with oxygen from the air. The subsequent mixture is ignited with the resulting expansion of gases pushing the cylinder and thus driving the nail into the work pieces. Typical within this design is the need for a fairly complicated assembly. Both electricity and fuel are required as the spark source derives its energy typically from batteries. In addition, it requires the chambering of an explosive mixture of fuel and the use of consumable fuel cartridges. Systems such as these are already in existence and are sold commercially to contractors under the Paslode name.

There are other nail guns that are available commercially, which operate using electrical energy. They are commonly found as electric staplers and electric brad tackers. The normal mode of operation for these devices is through the use of a solenoid that is driven off of a power cord that is plugged into a wall outlet. One of the drawbacks of these types of mechanisms is that the number of ampere-turns in the solenoid governs the force provided by a solenoid. In order to obtain the high forces required for driving brads and staples into the work piece, a larger number of turns are required in addition to high current pulses. These requirements are counterproductive as the resistance of the coil increases in direct proportion to the length of the wire in the solenoid windings. The increased resistance necessitates an increase in the operational voltage in order to keep the amps thru the windings at a high level and thus the ampere-turns at a sufficiently large level to obtain the high forces needed to drive the nail. This type of design suffers from a second drawback in that the force in a solenoid varies in relation to the distance of the solenoid core from the center of the windings. This limits most solenoid driven mechanisms to short stroke small load applications such as paper staplers or small brad tackers.

The prior art teaches three additional ways of driving a nail or staple. The first technique is based on a multiple impact design. In this design, a motor or other power source is connected to the impact anvil thru either a lost motion coupling or other. This allows the power source to make multiple impacts on the nail thus driving it into the work piece. There are several disadvantages in this design that include increased operator fatigue since the actuation technique is a series of blows rather than a continuous drive motion. A further disadvantage is that this technique requires the use of an energy absorbing mechanism once the nail is seated. This is needed to prevent the heavy anvil from causing excessive damage to the substrate. Additionally, the multiple impact designs normally require a very heavy mechanism to insure that the driver does not move during the driving operation.

A second design that is taught includes the use of potential energy storage mechanisms in the form of a spring. In these designs, the spring is cocked (or activated) through an electric motor. Once the spring is sufficiently compressed, the energy is released from the spring into the anvil (or nail driving piece) thus pushing the nail into the substrate. Several drawbacks exist to this design. These include the need for a complex system of compressing and controlling the spring and the fact that the force delivery characteristics of a spring are not well suited for driving nails. As the nail is driven into the wood, more force is needed as the stroke increases. This is inherently backwards to a springs unloading scheme in which it delivers less force as it returns to its zero energy state.

A third means for driving a fastener that is taught includes the use of flywheels as energy storage means. The flywheels are used to launch a hammering anvil that impacts the nail. This design is described in detail in U.S. Pat. Nos. 4,042,036, 5,511,715 and 5,320,270. The major drawback to this design is the problem of coupling the flywheel to the driving anvil. This prior art teaches the use of a friction clutching mechanism that is both complicated, heavy and subject to wear. This design also suffers from difficulty in controlling the energy left over after the nail is driven. Operator fatigue is also a concern as significant precession forces are present with flywheels that rotate in a continuous manner. An additional method of using a flywheel to store energy to drive a fastener is detailed in British Patent # 2,000,716. This patent teaches the use of a continuously rotating flywheel coupled to a toggle link mechanism to drive a fastener. This design is limited by the large precession forces incurred because of the continuously rotating flywheel and the complicated and unreliable nature of the toggle link mechanism.

All of the currently available devices suffer from a number of disadvantages that include:

1. Complex design. With the fuel driven mechanisms, portability is achieved but the design is complicated. Mechanisms from the prior art that utilize rotating flywheels have complicated coupling or clutching mechanisms based on frictional means. Devices that use springs to store potential energy suffer from reliability and complicated spring compression mechanisms.
2. Noisy. The ignition of an explosive mixture to drive a nail causes a very loud sound and presents combustion fumes in the vicinity of the device. Multiple impact devices are fatiguing and are noisy.
3. Complex operation. Combustion driven portable nail guns are more complicated to operate. They require fuel cartridges that need to be replaced and the combustion chamber must be cleaned.

4. Use of consumables. Combustion driven portable nail gun designs use a fuel cell that dispenses a flammable mixture into the piston combustion area. The degree of control over the nail driving operation is very crude as you are trying to control the explosion of a combustible mixture.
5. Non-portability. Traditional nail guns are tethered to a fixed compressor and thus must maintain a separate supply line.
6. Using a spring as a potential energy storage device suffers from unoptimized drive characteristics. Additionally springs are often not rated for these types of duty cycles leading to premature failure.
7. The flywheel type storage devices suffer from significant precession forces as the flywheels are kept rotating at high speeds. This makes tool positioning difficult. The use of counter-rotating flywheels as a solution to this issue increases the complexity and weight of the tool.
8. Need for precise motor control for repeatable drives. Flywheel designs that throw an anvil are very susceptible to damage in dry fire conditions.

BRIEF SUMMARY OF THE INVENTION

In accordance with the present invention, a fastening tool is described which derives its power from a low impedance electrical source, preferably rechargeable batteries, and uses a motor to drive a kinetic energy storage mechanism which is directly coupled to a fastener driving mechanism and drives a fastener into a substrate. Upon receipt of an actuation signal from an electrical switch, an electronic circuit connects a motor to the electrical power source. The motor is coupled to a kinetic energy storing mechanism, such as a flywheel, preferably through a speed reduction mechanism. In the description of this invention, the words kinetic energy storage mechanism and flywheel may be used interchangeably. Both the motor and the flywheel begin to spin. When the flywheel hits a certain rotational velocity or within a prescribed amount of time or within a certain number of revolutions, the flywheel is directly coupled to a fastener driving mechanism that drives the anvil through an output stroke. The preferred fastener driving mechanism is a linkage system which converts rotational motion to linear motion in a harmonic fashion and more preferably a slider crank style mechanism. In the description of this invention, the words slider crank and harmonic motion mechanism may be used interchangeably. The clutching mechanism is a mechanical lockup design that preferably includes a drive pin which rotates with the kinetic energy storage mechanism. The position of the drive pin is determined in response to both electrical and mechanical elements which allow for rapid and positive engagement and disengagement of the fastener driving mechanism to the energy stored in the flywheel. A sensor indicates at least one position of the fastener driving mechanism and can be used to coordinate the engagement of the drive pin or its disengagement. Additional sensors or timers associated with this sensor can be used to coordinate completion of the driving stroke with subsequent disconnection of the motor from the power source. Once the motor is disconnected from the power source, the kinetic energy storage mechanism can either come to a stop on its own or a brake can be used to stop the mechanism very quickly. The preferred mode for the braking mechanism, if used, is dynamic braking from the motor. The drive pin engagement is designed to be electrically controlled, such as with a solenoid, to increase the robustness of the design. The disengagement of the drive pin can be either by electrical or mechanical means. One such mechanical means would be to position a stationary cam substantially after the nail driving stroke has been completed. Upon revolution of the kinetic energy storage mechanism past the stationary cam, the drive pin is repositioned back to its disengagement position. Upon completion of the drive cycle, the fastener driving mechanism moves back to its starting position via an elastic biasing means such as a spring at which point the cycle is considered complete.

Accordingly, in addition to the objects and advantages of the portable electric nail gun as described above, several objects and advantages of the present invention are:

1. To provide a sensing element and control scheme that determine when the faster driving mechanism has begun a driving cycle, completed a cycle and is ready to initiate the next cycle.
2. To provide motor reversal for improved handling of jamb conditions during the nail driving stroke.
3. To provide a fastener driving mechanism that has low reciprocated inertia during the nail drive.
4. To provide a fastener driving device which uses an elastic means to return the fastener driving mechanism to its starting position thus simplifying the design.
5. To provide a fastener driving device that uses a positive acting clutch such as a drive pin which directly couples the flywheel to the fastener driving mechanism thus reducing frictional wear.
6. To provide a reciprocating driver which follows a hamonic displacement during the drive cycle thus providing controlled conversion of rotational to linear motion and decreasing sensitivity to dry fire (no fastener) conditions.
7. To provide an electrical clutching means for moving the drive pin to an engagement position.
8. To provide a clutching means which uses a stationary cam to ensure that the drive pin is retracted and a moving cam to ensure that the solenoid is retracted to eliminate double firing.
9. To provide a fastener driving mechanism which has compliance during impact and during its engagement positions thus reducing wear.

Further objects and advantages will become more apparent from a consideration of the ensuing description and drawings.

BRIEF DESCRIPTION OF THE SEVERAL VIEWS OF THE DRAWINGS

In the drawings, closely related figures have the same number but different alphabetic suffixes.

FIG. 4*a* is a front elevation and an isometric view of a slider crank mechanism including the preferred position sensitive crank link mechanism;

| Reference numbers in Drawings: | |
|---|---|
| 1 | Fastener Driving Tool |
| 2 | Fastener Driving Mechanism |
| 3 | Power Source |
| 4 | Motor |
| 5 | |
| 6 | Flywheel Gear |
| 7 | Flywheel Bar |
| 8 | |
| 9 | Control Circuit Device |
| 10 | Activation Switch |
| 11 | Fastener Driver Blade (Anvil) |
| 12 | Fastener (Nail) |
| 13 | Crank Link |
| 14 | |
| 15 | Flywheel Pinion |
| 16 | |
| 17 | Solenoid |
| 18 | |
| 19 | Drive Pin |
| 20 | Drive Shaft |
| 21 | Mechanism Return Spring |
| 22 | Handle |
| 23 | Feeder Mechanism |
| 24 | Substrate |
| 25 | Anvil Guide |
| 26 | Fastener driving Sensor |
| 27 | |
| 28 | |
| 29 | Motor Coupling |
| 30 | Top Dead Center Bumper |
| 31 | Bottom Dead Center Bumper |
| 32 | |
| 33 | Stationary Return Cam |
| 34 | |
| 35 | Rotating Return Cam |
| 36 | Speed Detection Sensor |
| 37 | Fastener Driving Assembly |
| 38 | Camming Mechanism |

DETAILED DESCRIPTION OF THE INVENTION

The operation of the invention in driving a nail into a substrate has significant improvements over that which has been described in the art. First, nails are loaded into a magazine structure. The nailing device is then placed against the substrates, which are to be fastened, and the trigger is actuated. The motor stores energy in a kinetic energy storage mechanism. The transfer from the kinetic energy storage mechanism to the fastener driving mechanism is by direct clutching means such as a shiftable drive pin. Once the pin has engaged the fastener driving mechanism to the kinetic energy storage mechanism, the fastener driving mechanism pushes the nail, or other fastener, into the substrate. The kinetic energy storage mechanism is a combination of the rotational kinetic energy stored in the entire drive train. This includes the motor, the power transmission means such as gears and the flywheel and drive pin assembly. The drive pin is a substantially rigid pin which moves from an engagement position to a disengagement position. The shape of the pin can be rectangular, polygonal or circular or a varied cross section. The pin can move either parallel or perpendicular to the flywheel axis to engage the fastener driving mechanism. Following the nail drive, the fastener driving mechanism is biased to a starting position via an elastic element such as a spring. These operations, from pulling the trigger to returning to a rest state constitute a cycle. This patent is a continuation in part of patent application no's xxxxx and yyyyy and material therein is incorporated by reference.

Preferred Embodiment of the Design

Figure 1:
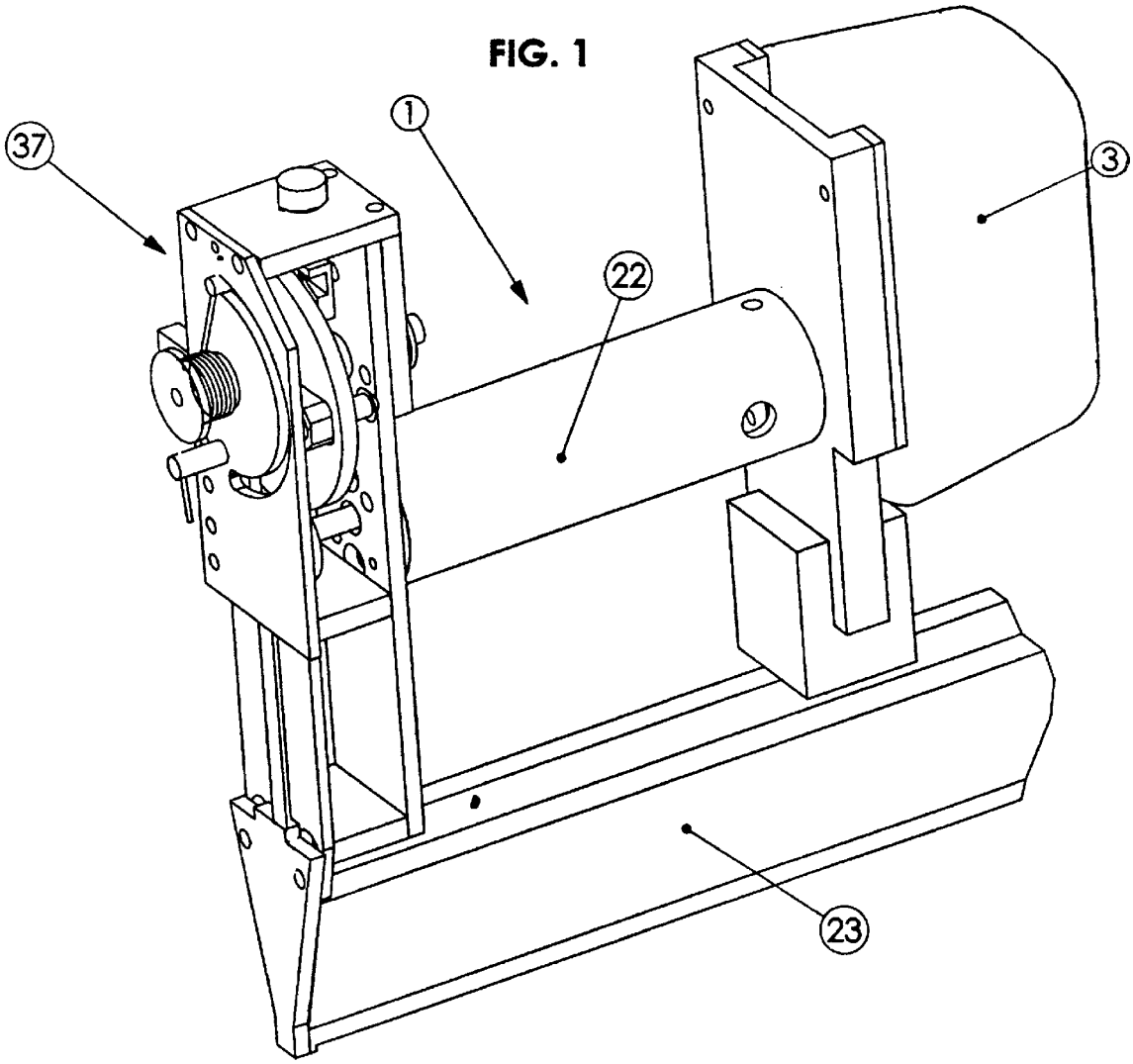
FIG. 1 is an overview of the fastener-driving tool embodying the invention.
Figure 2:
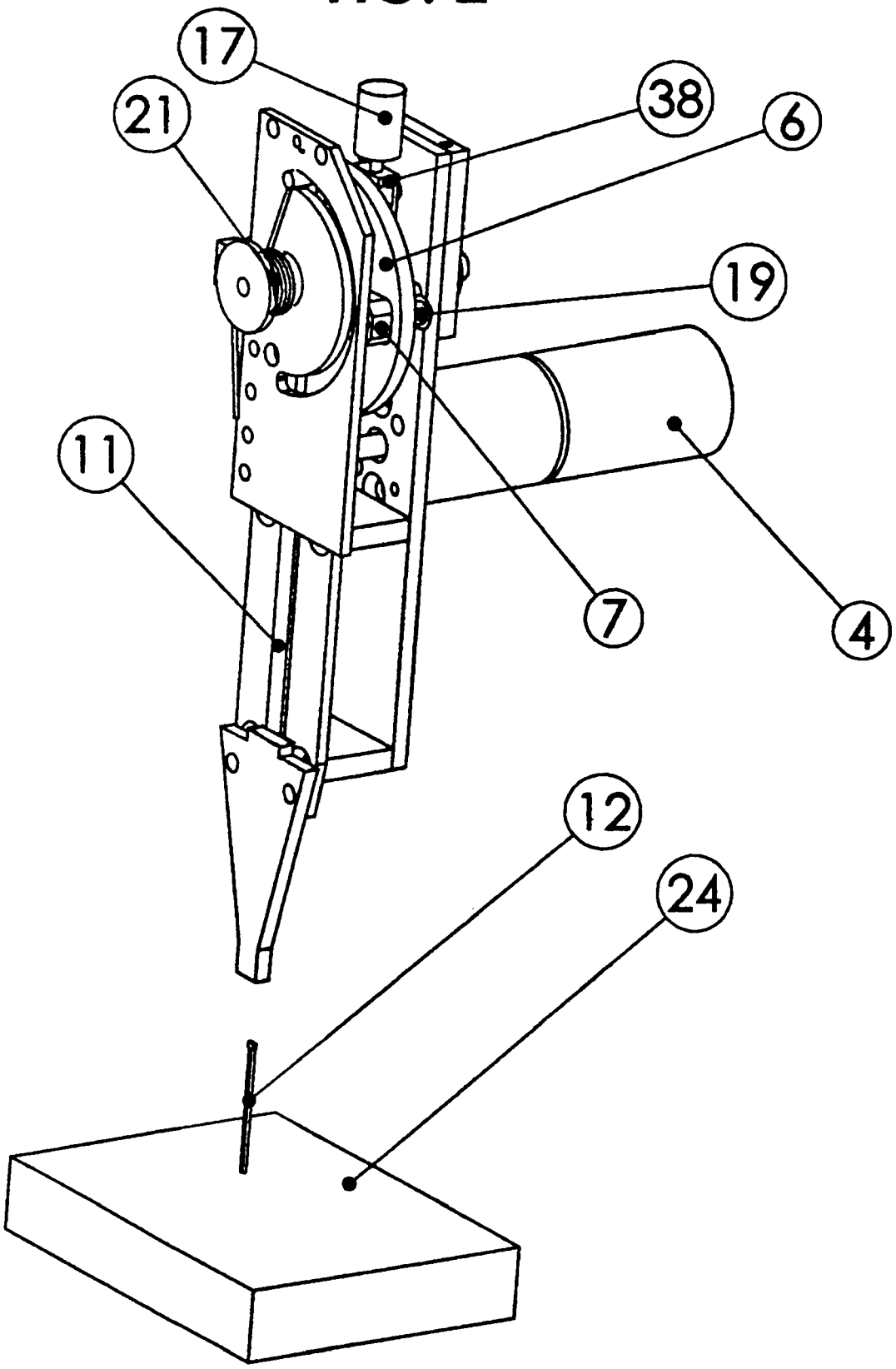
FIG. 2 is isometric view of the fastener driving mechanism detailing the mechanism.
Figure 3:
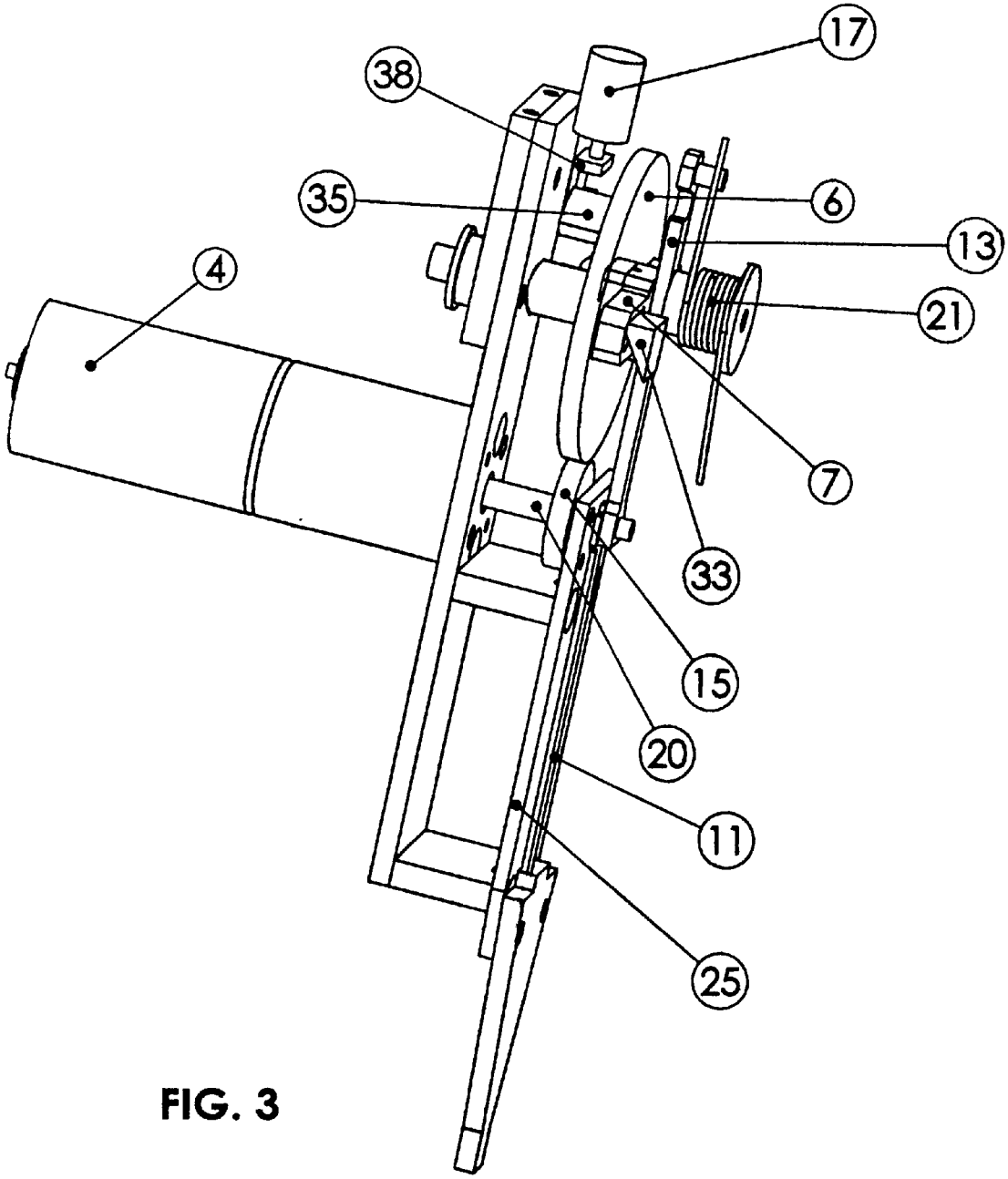
FIG. 3 is isometric view of the fastener driving mechanism detailing the mechanism.

FIGS. 1–6 represent a preferred embodiment of a fastener-driving tool (1) for driving fasteners such as nails (12) into substrates (24) such as wood. Referring to FIG. 1, the preferred embodiment includes a drive unit that can deliver a force through a stroke such as, for example, a fastener-driving tool (1). The fastener-driving tool (1) comprises a handle (22), a feeder mechanism (23), and the fastener driving assembly (37). The feeder mechanism is typically spring biased to force fasteners, such as nails or staples, serially one after the other, into position underneath the nail-driving anvil. FIGS. 2–4 detail the fastener driving assembly. Referring to FIG. 2, the motor (4) is controlled over a cycle to drive a fastener (12) beginning by placing the fastener-driving tool (1) against the substrates (24), which are to be fastened, and actuating a switch (10) shown in FIG. 6. This cycle ends when the fastener (12) has been driven and the fastener driving assembly (37) has returned to its starting position. This cycle can take up to 2 seconds but preferably takes less than 500 milliseconds.

Figure 4B:
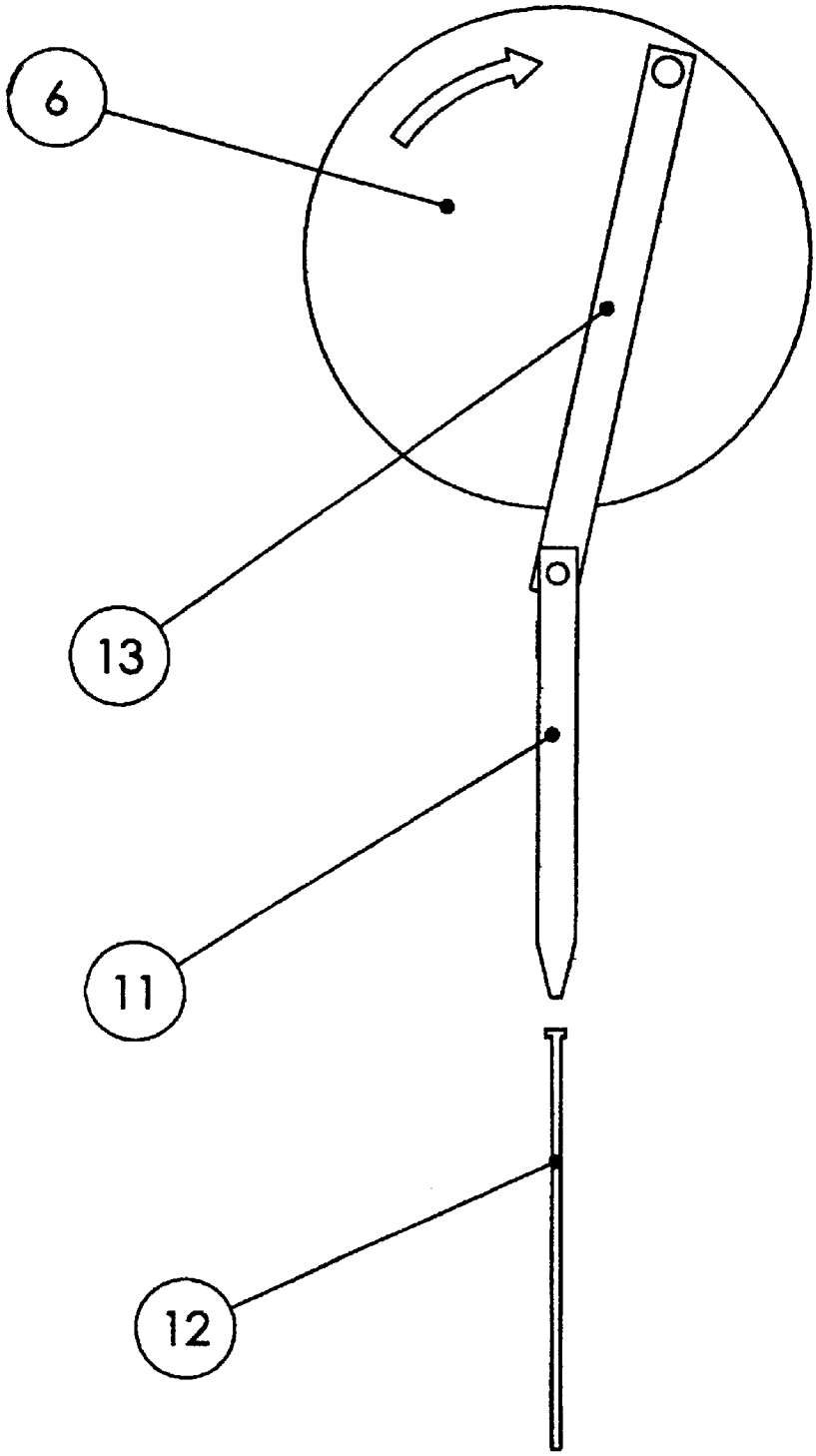
FIG. 4*b* is a front elevation of another embodiment of a slider crank mechanism.
Figure 5:
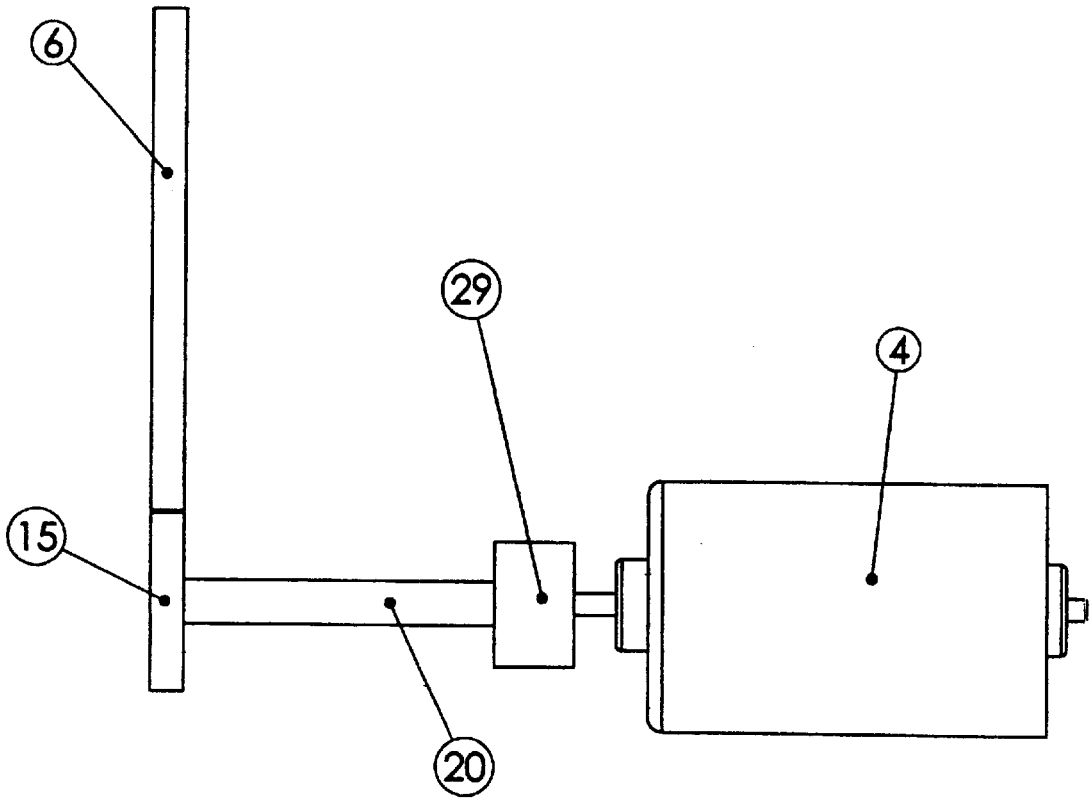
FIG. 5 is a side elevation of the motor, motor coupling and flexible shaft used in the nail driving mechanism.
Figure 6:
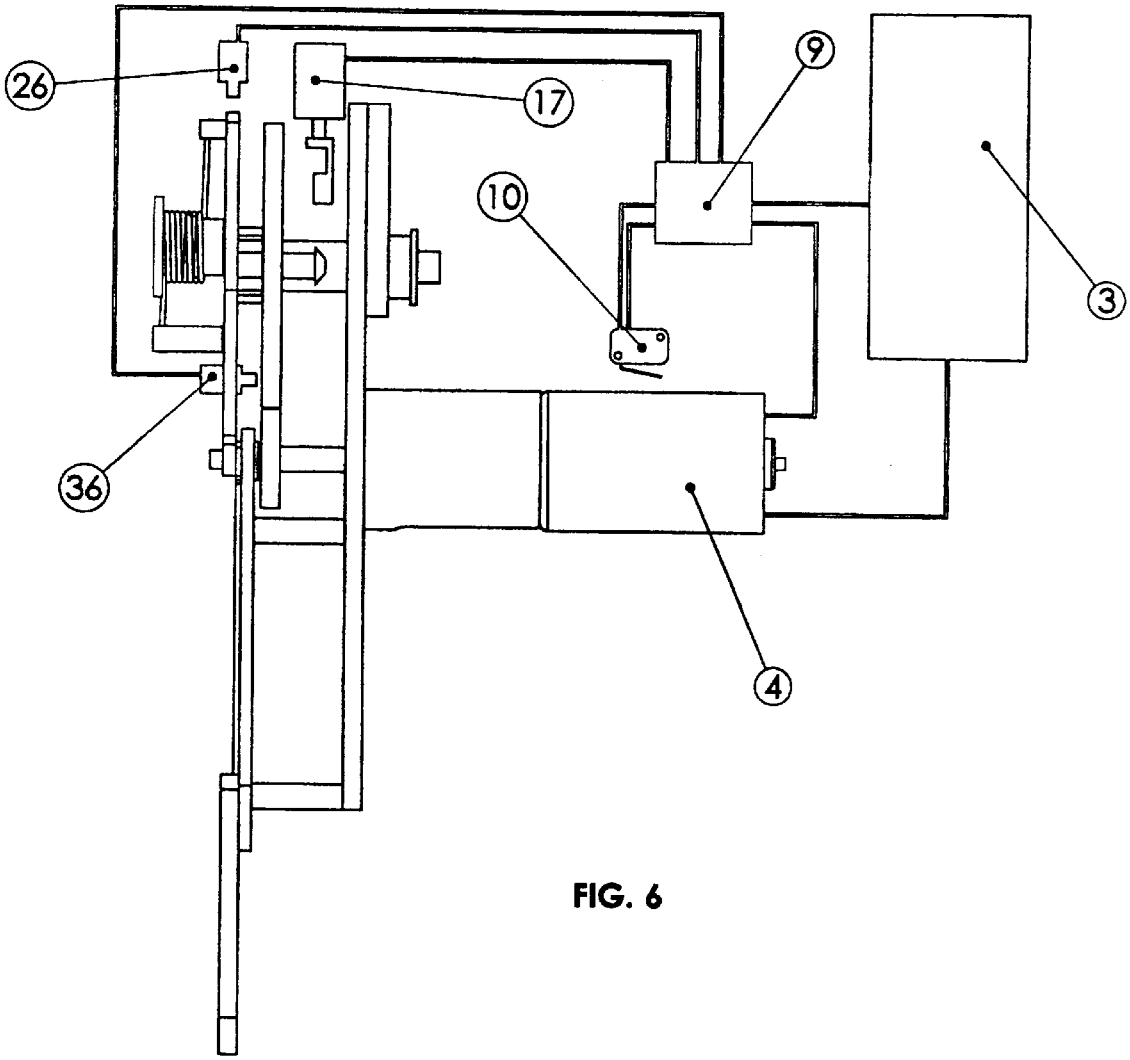
FIG. 6 is a schematic of the elements of a circuit for a fastener driving tool.

Referring to FIG. 6, the control circuitry device (9) and switch (10) apply power to the motor (4) from power source (3). Referring to FIGS. 2–3, the motor (4) is coupled to the drive shaft (20). The drive shaft (20) drives the flywheel gear (6) through the flywheel pinion (15). The applied power causes the flywheel gear to rotate. The ratio of the coupling between the motor to the flywheel gear is preferably about 3:1 but can be in a range from 1.5:1 to 10:1. It is recognized that although gears are mentioned throughout this discussion, various other mechanically coupling elements such as pulleys and belts could be used. Contained within the kinetic energy storage device is a shiftable drive pin (19) which forms the basis for the direct clutching means used in this invention. This drive pin (19) can have a direct engagement on the fastener driver mechanism (2) depending on its position. The preferred embodiment calls for this drive pin (19) to be shifted parallel to the flywheel gear axis in response to purely mechanical or electrical means or a combination of both. An example of all mechanical means for shifting the pin is from the inventor's earlier patent application no xxxxxx. The control circuitry device (9) which can be a simple set of switches but is preferably based on a small microprocessor awaits for a signal to engage the drive pin (19). This signal can be in response to either an elapsed amount of time from actuating switch (10) or a sensor which indicates that sufficient energy has been stored within the kinetic energy storage mechanism. In addition to this signal, the control circuit device (9) preferably evaluates an additional sensor, the fastener driving sensor (26) to ensure that the fastener driving mechanism (2) is in a suitable position to begin a fastener driving stroke. If these conditions are met, the control circuit device (9) initiates an electrical signal to position the drive pin (19). The preferred mode is to use a solenoid (17) to position a camming mechanism (38) such that within about one revolution of the flywheel gear (6) the drive pin (19) is moved to an engagement position. In the engagement position, the drive pin (19) is now positioned to directly transmit power from the kinetic energy storage means to the fastener driving mechanism (2). The preferred fastener driving mechanism (2) is based on a slider crank. Two potential slider crank mechanisms are shown in FIGS. 4*a* and 4*b*. In the preferred embodiment, the flywheel bar (7) and the drive pin (19) engage the crank link (13) to form a slider crank mechanism.

After the solenoid (17) positions the camming mechanism (38) to shift the drive pin (19), a rotating return cam (35)

mounted on the flywheel gear (6) can be used to ensure the camming mechanism (38) gets retracted and does not remain in its engagement position. This rotating return cam (35) is typically mounted between 30 and 180 degrees behind the drive pin (19) to allow the solenoid's magnetic coil field to collapse before it moves the camming mechanism (38) back into its rest position.

Upon formation of this slider crank mechanism the fastener drive cycle is initiated. The anvil (11) slides up and down the anvil guide (25) and makes contact to drive the nail (12). In this preferred embodiment, a fastener driving sensor (26) provides a signal to the control circuit device (9) at or near the place of initial contact of the drive pin (19) to the slider crank mechanism. The control circuit device uses either an additional sensor or a delay timer to indicate the end of the driving stroke. If a delay timer is used, this delay is less than 15 milliseconds and preferably less than 8 milliseconds. Upon timeout of this timer or an indication from another sensor that the anvil (11) has hit bottom dead center, the drive stroke is deemed to be complete and the motor (4) is disconnected from the power source (3). In addition, upon completion of the driver stroke the motor (4) can act as a dynamic brake in order to facilitate release of the drive pin (19) from the fastener driving mechanism (2).

In the preferred embodiment, after the anvil (11) reaches bottom dead center, the crank link (13) automatically disengages from the drive pin (19). It should be understood that bottom dead center (BDC) and top dead center (TDC) refer to approximate positions of the fastener driving mechanism. In the preferred embodiment, the crank link (13) is designed only to engage the drive pin (19) from about TDC to about BDC and can not be driven by the drive pin (19) past about BDC due to the design of the crank link (13). This makes the crank link (13) position sensitive and it is depicted in FIG. 4*a*. After the crank link (13) disengages from the drive pin (19) the crank link (13) hits the bottom bumper (31). The bottom bumper (31) is designed to absorb the remaining energy in the crank link (13) and is preferably made of an elastic material. This remaining energy is typically less than 10 inch-lbs. Returning to FIG. 3, once the anvil (11) moves past bottom dead center the drive pin (19) can be forced to retract by the stationary return cam (33). This stationary return cam (33) would be in a position of preferably about 45 to 135 degrees after the bottom of the stroke. The drive pin (19) is then retracted and no longer protrudes from the face of the flywheel bar (7). The mechanism return spring (21) then biases the crank link (13) and the anvil (11) towards a starting position against the top bumper (30) in readiness for the next cycle. The mechanism return spring (21) can be any elastic element. The preferred element in this application is a torsion spring.

In this preferred embodiment, the flywheel gear (6) is connected to the flywheel bar (7). It should be understood within the scope of this invention that the flywheel bar (7) is described as rectangular shape but could also be a variation thereof including a bar tapered from the center of rotation. The defining geometric feature is that its average length is at least 1.5 times as long as its average width. The flywheel bar (7) serves several purposes. The flywheel bar (7) is a rectangular steel bar that has a precision hole drilled in it to act as the guide for the drive pin (19). A long guiding surface is important to prevent the drive pin (19) from binding when it is being shifted in and out by either a solenoid or other camming means. An additional benefit of this bar containing the drive pin is that the rotational inertia of the system can be reduced for fastener driving tools with larger strokes. This is accomplished by extending the bar out past the flywheel gear (6) and the flywheel pinion (15). This allows higher speeds to be achieved in the kinetic energy storage mechanism. These higher speeds result in faster drive times and less reaction on the operator. In the preferred embodiment, the flywheel bar (7) can pivot or flex rotationally up to 45 degrees in relation to the flywheel gear (6). The preferred method to accomplish this is to add compliance between the flywheel bar (7) and the flywheel gear (6). The flywheel bar is biased towards one end of the flywheel gear (6) and upon drive pin (19) impact to a link in the fastener driving mechanism (2) the flywheel bar (7) can rotate against a compliant means to reduce the impact stresses. This compliant means can be in the form of a spring, an elastomeric material or a designed flexure element.

During the various impacts which occur in such a fastener driving tool such as the impact between the drive pin to the fastener driving mechanism and the fastener driving mechanism to the nail, large dynamic forces are involved. These forces should be mitigated thru the use of shock absorbing means if the tool is to have a long life. When the drive pin (19) engages the crank link (13), all of the energy to accelerate the crank link to speed must be delivered quickly. This energy comes from all rotating elements of the drive train. The motor inertia represents a significant portion of the overall rotational kinetic energy. Any inertia not present in the flywheel gear (6) or flywheel bar (7) must be transferred through the gear teeth. If this transfer takes place nearly instantaneously i.e. over a small angular displacement, the forces on the gear teeth can exceed the rating for the gears and cause excessive gear wear. To prevent excessive wear the torque transmitted through the gears and the fastener driving mechanism must be below the yield rating for these materials. To achieve this effect the energy must be supplied over a larger time period, or an increased angular displacement. This is accomplished by introducing compliance which we define as linear and angular flexibility within the kinetic energy storage mechanism and the nail driving mechanism (2). This compliance is of such a nature that the yield points of the various component materials are not exceeded upon impact of the drive pin (19) to the fastener driving mechanism. One method for accomplishing this is described below although others may be used by those skilled in the art without departing from the spirit of this invention. The preferred method is to allow for twist in the components which couple the motor to the flywheel pinion. In the preferred design, this twist is accomplished through the use of a flexible motor coupling (29) and may include an engineered drive shaft (20) shown in FIG. 5. The result of this arrangement is an allowable twist of between 1–15° of angular rotation between the motor rotor and the flywheel pinion (15). This twist is sufficient to allow the impact load to be spread across the surface of a gear tooth and more preferable across the surface of several gear teeth thus reducing wear.

Additionally, it will be understood various changes in details, materials, arrangements or parts and operating conditions which have been herein described and illustrated in order to explain the nature of the invention may be made by those skilled in the art within the principles and scope of the invention.

Circuit Operation

Figure 7:
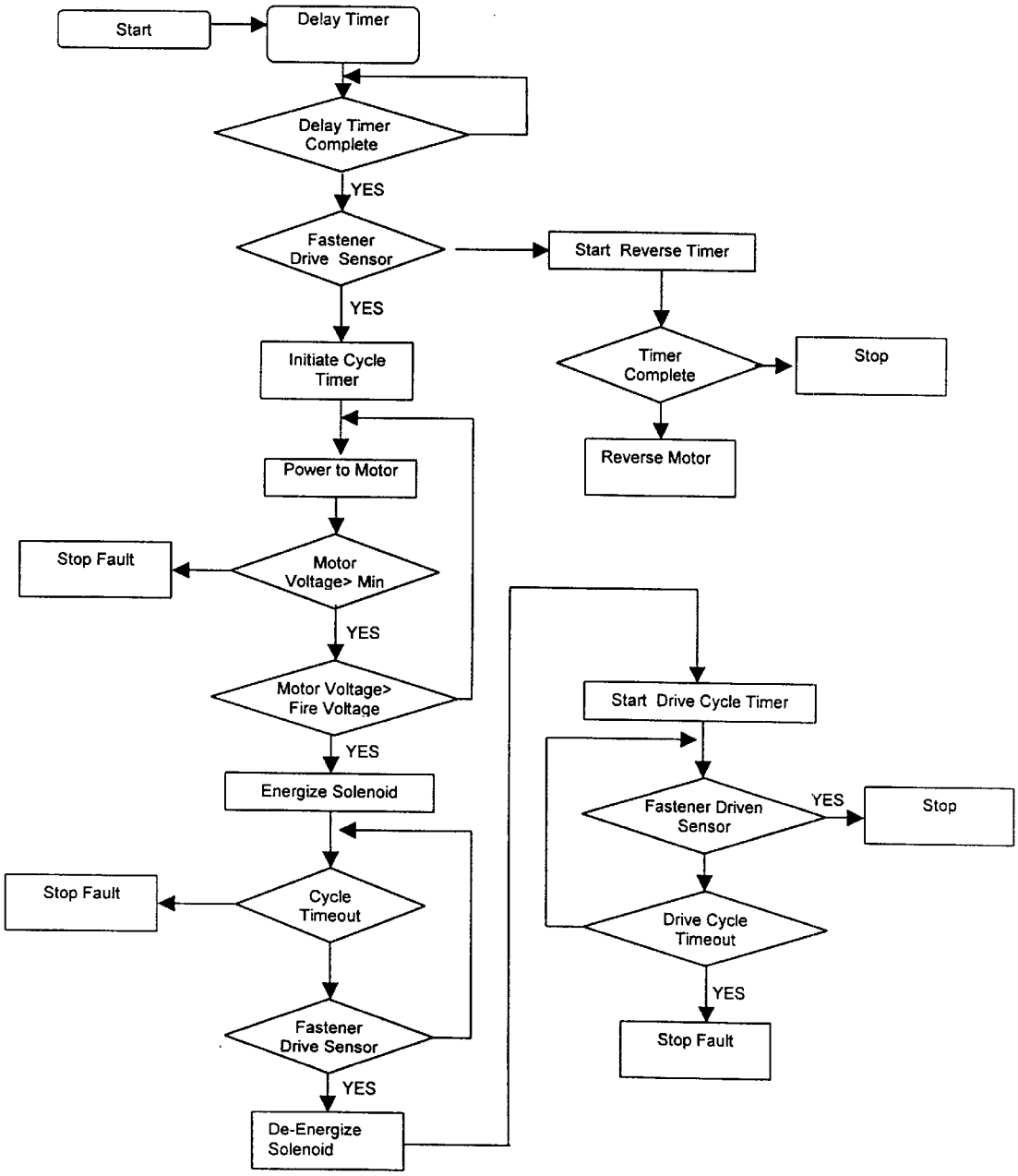
FIG. 7 is a Simplified Flowchart of the Control Circuitry Device Functionality for Tool Operation

Refer to FIG. 7 for a simplified flowchart of circuit operation for the preferred embodiment which engages the positive acting clutch electrically. In the following description, the positive acting clutch is engaged with a solenoid and uses a shiftable drive pin, but it is understood that various electrical actuation means could be used to engage the clutch. These means include: a motor with for example a lead screw a shape memory alloy, and electromagnet or others. It should also be understood that this circuit operation could be simplified through the use of an all mechanical clutching means such as the inventors asynchronous clutch.

Upon initiation of the tool cycle, there is a short delay to allow all inputs and voltages to stabilize in the circuit. After this delay, a sensor is used to determine that the fastener driving mechanism is in position to begin the cycle. If it is not, the motor begins in a reverse direction for either a preset time or prescribed rotational period to allow the tool to reset into a normal operative condition. If the fastener driving mechanism is in the correct position, power is applied motor in the normal direction. This power may be pulse width modulated as commonly used in drills to allow for a softer start. Upon initiation of power to the motor, a cycle timer may be started. If this timer times out before the drive cycle is complete, a fault condition exists and the fastener driving tool is deactivated. In the preferable tool, voltage is checked during the initiation of the cycle to ensure sufficient battery power to complete the cycle. If it pasts this test, the control circuit device monitors the speed of the motor until it exceeds the minimum engagement threshold.

Once it exceeds this threshold, the control circuit device gives an electrical signal to the solenoid moving the drive pin to the engagement position. This signal causes positive engagement of the kinetic energy storage device to the fastener driving mechanism. Upon initial movement of the fastener driving mechanism, the electrical signal is removed from the solenoid to allow return to its inactive position. Furthermore, upon initial movement, a drive cycle timer is preferably started. The cycle is continued until either a sensor which indicates that the fastener has completed the drive is activated or the drive cycle timer times out. Upon either of these events, the cycle is completed and the motor is deactivated. Depending on the operation mode of the tool and the states of the various starting and safety switches, a new cycle can now be initiated.

In the preferred embodiment as mentioned above, the direction of tool rotation is reversible in order to allow most robust operation of the tool. This embodiment is useful in several ways.

1. First, in order to clear a jamb condition in which the anvil is down, reversing the initial direction of the motor facilitates an uncoupling of the drive pin (19) from the fastener driving mechanism. (2)
2. Secondly, when a mechanical asynchronous clutch is used, the reversibility can allow more consistent energy input to the mechanism.

In a further embodiment, the kinetic energy storage device contains a sensor which provides a signal corresponding to a revolution or fraction thereof. This sensor can be used in conjunction with the control circuit device to:

1. Shut the tool off if sufficient energy is not stored within a prescribed amount of time.
2. Time the actuation of the solenoid for drive pin actuation
3. Time the motor shutoff upon completion of the fastener drive
4. Ensure that a certain number of revolutions are always available to drive the fastener for the mechanical asynchronous clutch.

The preferred location of these sensors follows. The kinetic energy storage device sensor is located at or near the position of the drive pin when it has finished the nail drive stroke. The fastener driving sensor (26) is preferably located at top dead center of the mechanism where the crank link (13) would first engage the drive pin (19). It is understood by those skilled in the art that the sensors can be used in conjunction with circuit elements to allow location at different places on the fastener driving tool. Additionally, it is understood that sensors can be of many forms including but not limited to limit switches, hall effect sensors and reed switches.

It should be understood that various operating variations could be incorporated into the circuitry by one familiar with the art and still fall within the scope of this invention.

We claim:

1. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a shiftable drive pin contained within the kinetic energy storing mechanism;

a fastener driving mechanism;

means for engaging said shiftable drive pin with said fastener driving mechanism;

a fastener;

means for bringing the fastener driving mechanism into contact with said fastener to drive said fastener into a substrate material; and a sensor for determining at least one position of the fastener driving mechanism.

2. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a shiftable drive pin contained within the kinetic energy storing mechanism;

a fastener driving mechanism;

means for engaging said shiftable drive pin with said fastener driving mechanism;

a fastener;

means for bringing the fastener driving mechanism into contact with said fastener to drive said fastener into a substrate material; and an elastic means for biasing the fastener driving mechanism to a starting position.

3. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a shiftable drive pin contained within the kinetic energy storing mechanism;

a fastener driving mechanism;

means for engaging said shiftable drive pin with said fastener driving mechanism wherein said means follows a harmonic motion during the drive cycle;

a fastener; and means for bringing the fastener driving mechanism into contact with said fastener to drive said fastener into a substrate material.

4. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

a means for coupling said motor to said kinetic energy storing mechanism to allow the motor to supply and transfer energy to said kinetic energy storing mechanism;

a positive acting clutching mechanism;

means for engaging said positive acting clutching mechanism with said kinetic energy storing mechanism;

a fastener driving mechanism;

a compliant means for engaging said positive acting clutching mechanism with said fastener driving mechanism;

a fastener; and means for bringing the fastener driving mechanism into contact with said fastener to drive said fastener into a substrate material.

5. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a shiftable drive pin contained within the kinetic energy storing mechanism;

a fastener driving mechanism;

an electrical actuation means for engaging said shiftable drive pin with said fastener driving mechanism;

a fastener; and means for bringing the fastener driving mechanism into contact with said fastener to drive said fastener into a substrate material.

6. An apparatus for driving a fastener into a material comprising:

a power source;

a control circuitry device coupled to said power source;

a motor;

means for coupling said control circuitry device to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a clutching mechanism;

means for engaging said clutching mechanism with said kinetic energy storing mechanism;

a positive sensitive fastener driving mechanism;

means for engaging said clutching mechanism with said position sensitive fastener driving mechanism;

a fastener; and means for bringing the position sensitive fastener driving mechanism into contact with said fastener to drive said fastener into a substrate material.

7. The apparatus according to claim 1,2,3,4,5 or 6, wherein the kinetic energy storage mechanism is further comprised of a sensor which provides a signal corresponding to a revolution or fraction thereof of the kinetic energy storage mechanism.

8. The apparatus according to claim 1,2,3,4 or 5, wherein at least one position of the shiftable drive pin is controlled in response to a solenoid.

9. The apparatus according to claim 3, wherein said means for engaging the shiftable drive pin with said fastener driving mechanism is a slider crank mechanism.

10. The apparatus according to claim 1,2,3,4,5 or 6, wherein extra energy in the fastener driving mechanism at the end of the fastener drive stroke is absorbed by elastomeric bumpers.

11. The apparatus according to claim 5, further comprising a stationary cam that pushes the shiftable drive pin into a disengaged position relative to the fastener driving mechanism.

12. The apparatus according to claim 5, further comprising a rotating cam that pushes the electrical actuation means into a return position.

13. The apparatus according to claim 1,2,3,4,5 or 6, wherein the kinetic energy storage mechanism is further comprised of a flywheel bar containing the shiftable drive pin.

14. The apparatus according to claim 13, wherein the flywheel bar is elastically coupled to allow for between 1 and 45 degrees of relative motion between said flywheel bar and the remaining elements of the kinetic energy storage mechanism.

15. The apparatus according to claim 1,3,4,5 or 6, wherein the fastener driving mechanism is biased to its starting position by an elastic element.

16. The apparatus according to claim 1,2,3,4 or 6, further comprising a brake that is engaged at or near the completion of the drive stroke of the fastener driving mechanism.

17. The apparatus according to claim 1,2,3,4,5 or 6, wherein the rotational direction of the motor is reversible.

18. The apparatus according to claim 9, wherein the slider crank mechanism ids further comprised of linkage components having holes, slots or channels to reduce the mass of the linkage components.

19. The apparatus according to claim 5, wherein the electrical actuation means is in response to a minimum energy stored in the kinetic energy storage mechanism.

20. The apparatus according to claim 1,2,3,4,5 or 6 wherein said means for coupling the motor to the kinetic energy storage mechanism further allows at least 1 degrees of compliant twist during a fastener drive cycle.

21. The apparatus according to claim 6, wherein the position sensitive fastener driving mechanism engages the clutching mechanism in a range of +/−60 degrees around the top dead center position of the position sensitive fastener driving mechanism and disengages the clutching mechanism in a range of −10 to +90 degrees around the bottom dead center position of the position sensitive fastener driving mechanism.

22. The apparatus according to claim 1,2,3,4,5 or 6 wherein the control circuitry device is further comprised of a cooling fan which runs independently of the motor.

* * * * *